United States Patent [19]

Hoofe, III

[11] 4,251,967

[45] Feb. 24, 1981

[54] WEATHERPROOF ROOFING PANELS

[76] Inventor: William J. Hoofe, III, 1816 Newport Hills Dr. East, Newport Beach, Calif. 92660

[21] Appl. No.: 890,474

[22] Filed: Mar. 27, 1978

[51] Int. Cl.[3] ..... E04D 1/00

[52] U.S. Cl. ..... 52/535; 52/527; 52/542; 52/555

[58] Field of Search ..... 52/526, 535, 536, 537, 52/549, 555, 560, 519, 523, 554, 314, 527, 533, 557, 558, 542

[56] References Cited

U.S. PATENT DOCUMENTS

| | | | |
|---|---|---|---|
| 3,485,002 | 12/1969 | Barer | 52/555 X |
| 3,605,369 | 9/1971 | Merrill et al. | 52/542 X |
| 3,899,855 | 8/1975 | Gadsby | 52/555 X |
| 4,015,391 | 4/1977 | Epstein et al. | 52/555 X |

*Primary Examiner*—Carl D. Friedman

*Attorney, Agent, or Firm*—Blakely, Sokoloff, Taylor & Zafman

[57] ABSTRACT

An improved simulated tile roofing panel is disclosed. The panel comprises a background sheet of relatively thin material, such as ABS in which are integrally formed one or more raised elongated tile segments, disposed in a substantially parallel spaced relationship. The respective ends of the tile segments are formed with cooperating portions so that the ends of the tiles on adjacent panels interlock to retain the panels in position, to present a realistic Spanish tile appearance, and to improve the watershedding capabilities of interlocked panels. Other features, improvements and alternate embodiments are disclosed.

23 Claims, 11 Drawing Figures

Fig. 1
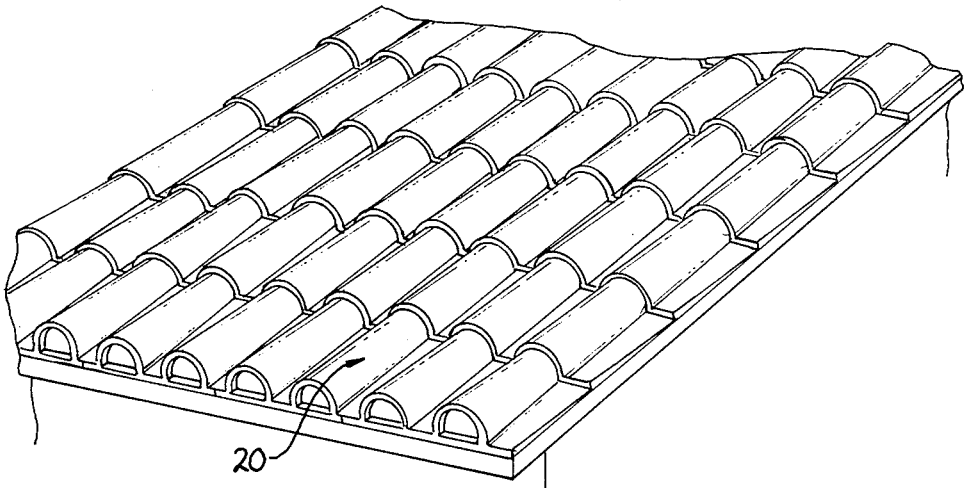
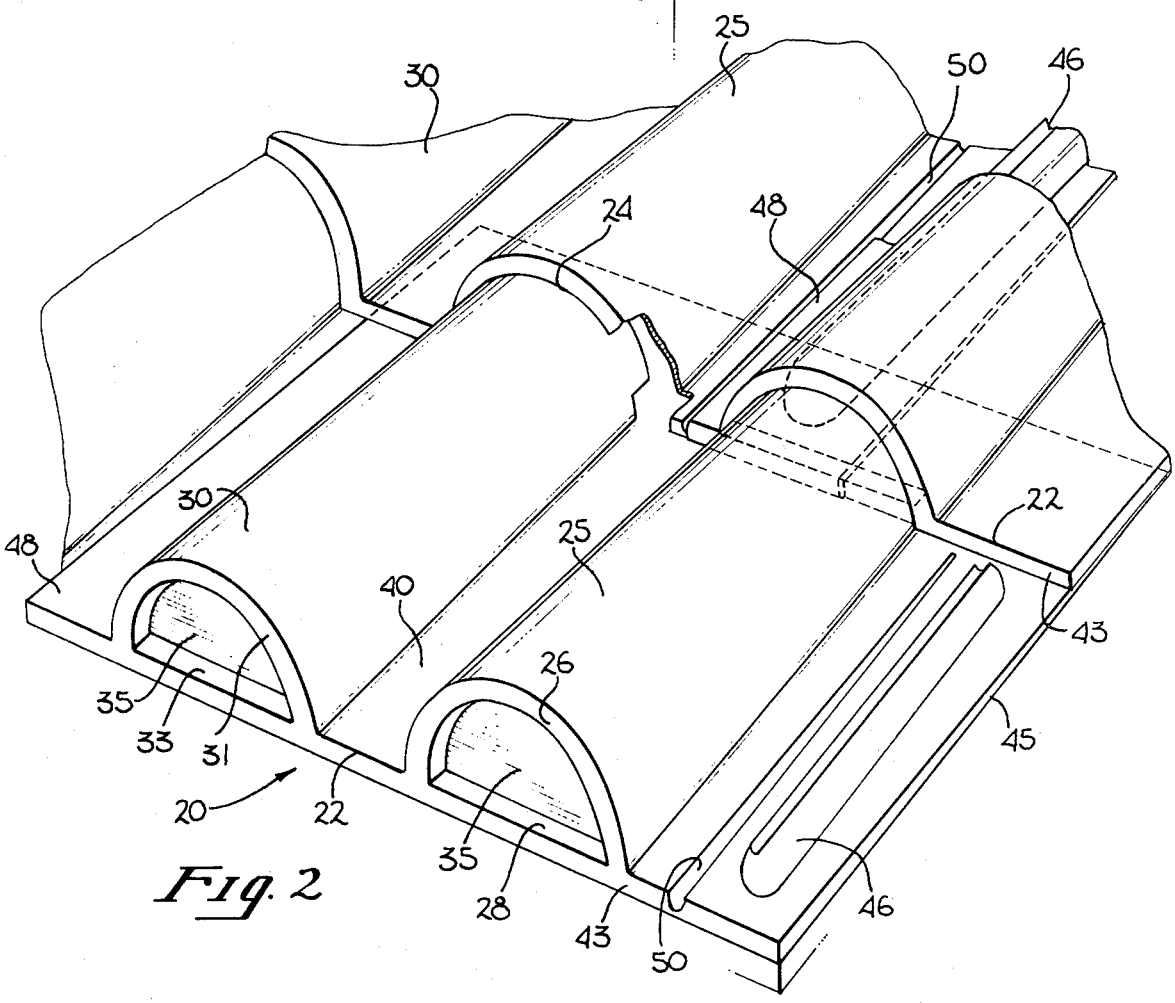
Fig. 2

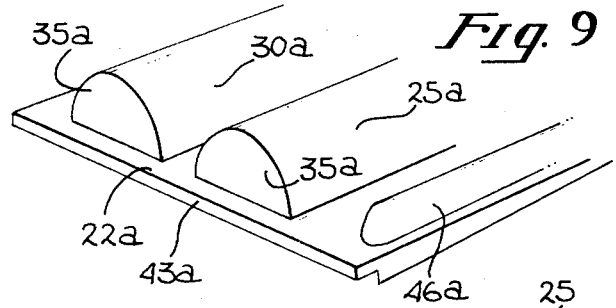
Fig. 9
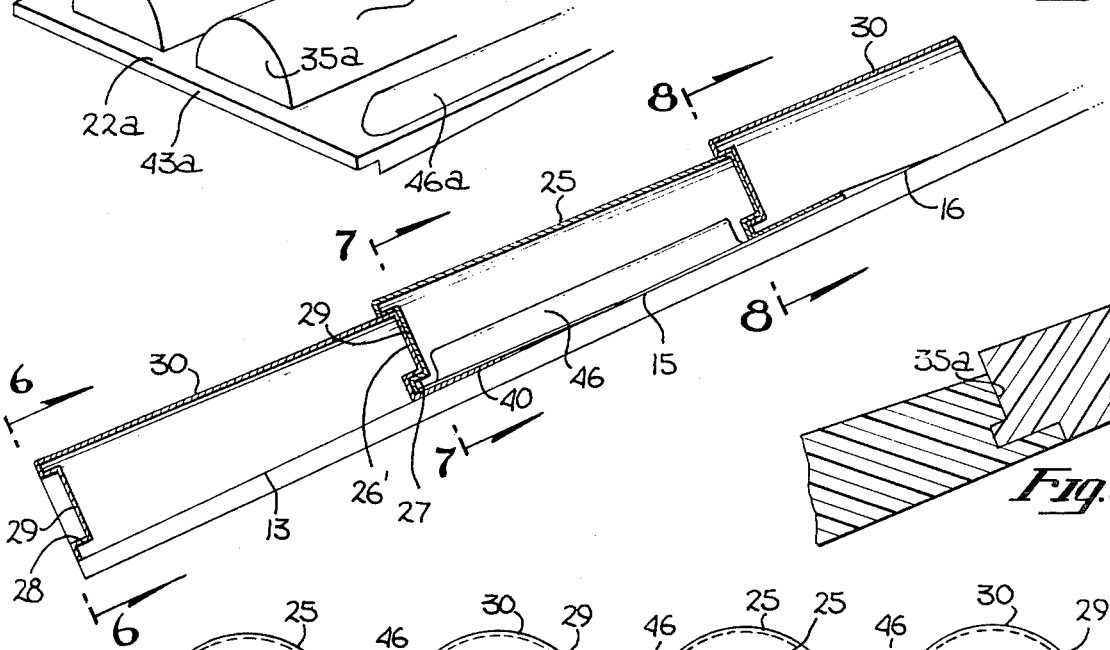
Fig. 5
Fig. 10
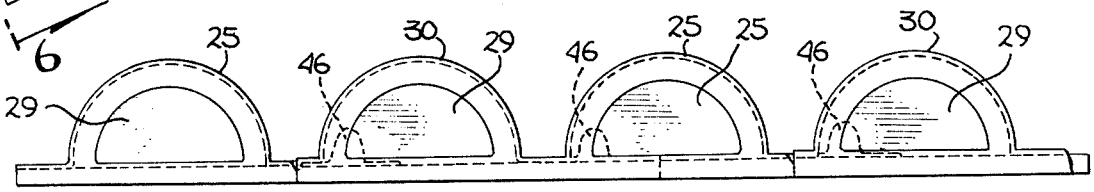
Fig. 6
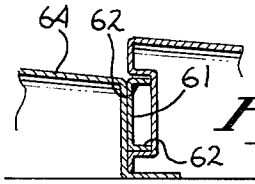
Fig. 11
Fig. 7
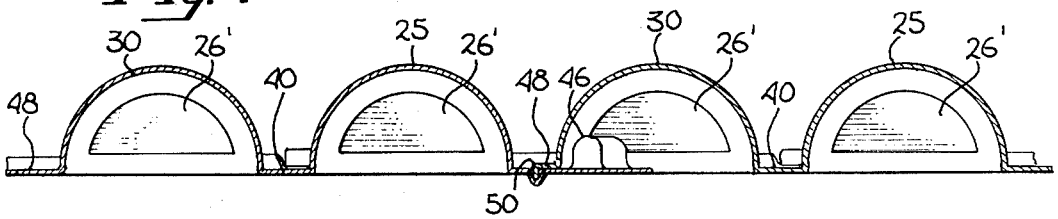
Fig. 8
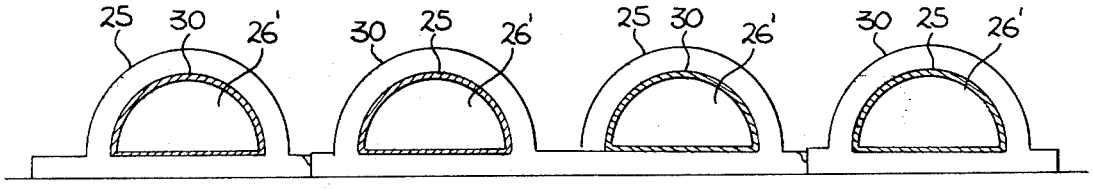

WEATHERPROOF ROOFING PANELS

BACKGROUND OF THE INVENTION

1. Field of the Invention:

The present invention relates to the field of roofing materials, and in particular, to interlocking decorative roofing panels.

2. Description of the Prior Art

Spanish tile is a common roofing material in many parts of the country. While this type of roofing material is highly durable, it suffers the disadvantages of (i) relatively high weight, (ii) high cost of installation, as a substantial amount of hand labor is required to properly lay the tile to form a water-tight roof, and (iii) the high cost of the tiles. Another popular roofing material is wood shake or shingles which also have the disadvantages of relatively high labor and material costs. Due to the disadvantages of these common roofing materials, attempts have been made to substitute for the conventional materials roofing panels which simulate the appearance of these materials, and yet are substantially lighter in weight and less expensive to manufacture and install. For example, U.S. Pat. No. 3,485,002 discloses a roofing panel simulating the appearance of Spanish tile. However, while the disclosed tile structures are highly satisfactory for installations which require only a single course of panels, no provision is made for interlocking adjacent panels to prevent entrance of moisture and to maintain a realistic appearance by minimizing discontinuities between tile courses. To the applicant's knowledge, no roofing panel simulating conventional roofing material such as tile is available which combines the advantages of low cost, attractive appearance and the requisite water shedding capabilities required by the outdoor application for large area coverage.

BRIEF SUMMARY OF THE INVENTION

A light weight roofing panel is disclosed having raised decorative elements thereon, portions of which cooperate with appropriately formed portions of adjacent decorative elements to interlock adjacent panels together. Preferably the panels are formed of sheets of relatively thin material, such as ABS.

The invention comprises, in general, (i) a substantially planar background sheet member, (ii) decorative elements formed on the sheet member and raised with respect thereto, (iii) cooperating interlock means integrally formed from portions of the decorative elements for interlocking adjacent front and back ends of adjacent panels, and (iv), side interlock means integrally formed from the background sheet member to interlock overlapping side edges of adjacent panels in the same course.

In the preferred embodiment, the decorative elements are simulated Spanish tile segments, disposed lengthwise from the panel front to back in a spaced relationship. The panel end interlocking is achieved by the fitting together of adjacent complementing surfaces of tiles of adjacent panels. A protruding lip extends along the bottom front end of the tile segment; a complementing channel is found along the bottom rear end of the tile segment by an overhanging portion. When panels are placed end to end, preferably in a staggered relationship, the lip portion along the panel front is received within the channel along the back edge of the adjacent panel. The interlocking of the sides of adjacent panels is achieved by the formation of a channel extending along one side of the panel which is adapted to receive the lipped side edge of an adjacent panel. An elongated protrusion is formed in the background sheet member between the channel and the panel edge, and fits under a tile segment of an adjacent panel, providing further interfitting to resist entrance of water. A further advantage of the panels is that they may be installed by nails which are hidden by overlapping portions of adjacent panels. Nailing only at the top of the panels provides adequate retention and allows the lower end of each panel to float as necessary to compensate for the differential thermal expansion.

BRIEF DESCRIPTION OF THE DRAWINGS

FIG. 1 is a perspective view of a roof covered with a plurality of the preferred embodiment of the roofing panels comprising the subject invention.

FIG. 2 is an enlarged perspective view of the subject roofing panels as installed, and being partially cut-away to show the panel end interlocking.

FIG. 5 is a lengthwise cross-sectional view of the subject roofing panels, taken through line 5—5 of FIG. 4.

FIG. 6 is an end view of the subject roofing panels, taken from line 6—6 of FIG. 5.

FIG. 7 is a cross-sectional view of the subject roofing panels, taken along line 7—7 of FIG. 5.

FIG. 8 is a cross-sectional view of the subject roofing panels, taken along line 8—8 of FIG. 5.

FIG. 9 is a perspective view of an alternative embodiment of the present invention wherein the roofing panel is a solid foam article.

FIG. 10 is a cross-sectional view of the alternate embodiment of FIG. 9, showing the interlocking of the ends of the panels.

FIG. 11 is a cross-sectional view of second alternate embodiments, showing an alternative construction of the interlocking portions of the panels.

DETAILED DESCRIPTION OF THE INVENTION

Figure 3:
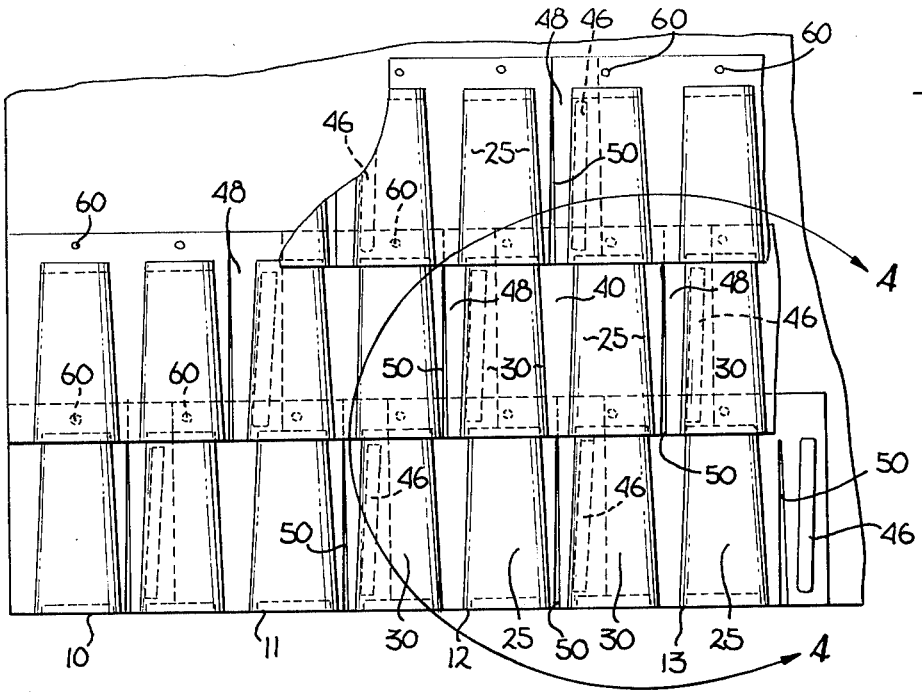
FIG. 3 is a top view of a plurality of the installed roofing panels.

The present invention comprises a roofing panel with raised, repeating decorative patterns, portions of the decorative pattern being adapted for interlocking with other panels to form a substantially watertight roof covering. While the decorative pattern that is illustrated in the Figures is a simulated Spanish tile design, it is to be understood that other decorative panels could as well be used, as the present invention is applicable to the simulation of any roofing covering characterized by individual elements set on the roof in spaced apart disposition.

The preferred embodiment is fabricated from a substantially rigid material such as ABS (acrylonitrile-butadiene-styrene), though other plastic materials or metals will also be found suitable. The panels may be painted or otherwise treated to closely simulate that of tile, shake or other material being simulated. The panels are preferably fabricated from sheets of the ABS utilizing vacuum molding techniques, though alternative manufacturing processes, including injection molding, foam molding and the like may also be used. Thus, the preferred embodiment comprises an integral, one-piece panel of a relatively thin rigid material, the sheet material being forced by the combination of pressure and heat to assume the contours of the mold. Of course, a roofing panel could be constructed of discrete elements similar in nature to the described elements and in accordance with the spirit of the invention, one such embodiment being subsequently described.

Referring now to FIGS. 1 and 2, the preferred embodiment of the invention is shown. FIG. 1 illustrates a section of roof covered with the subject panels; the panels 20 illustrated giving the appearance of authentic Spanish tile roofing. FIGS. 1 and 2 show, in perspective, panels 20 interlocking with other similar panels, FIG. 2 specifically illustrates the overlapped portion in phantom. Each panel 20 comprises a background sheet member 40, from which first and second decorative tile members 25 and 30 extend in relief. While the figures illustrate a panel having two tile members per panel, it is of course within the purview of the subject invention to fabricate panels having only one or more than two decorative elements on each panel, as well as one or more courses. Simulated tile members 20 and 30 have generally semi-circular cross-sectional configurations, and are tapered from the panel front to panel back, i.e. the cross-sectional dimension decreases from the front edge 22 of the panel to the rear region 24.

Depressions 35 are formed in each end 26 and 31 of the tile elements to simulate the hollow nature of authentic ceramic tile. As will be discussed more fully hereinbelow, in one embodiment depressions 35 also serve to define complementing surfaces for interlocking adjacent panels.

Referring now to FIGS. 2 and 5, the details of construction of the rear portion of the tile members are illustrated. As may be seen, overhang portion 29 of the tile extends over a portion of background sheet member 40, forming a channel 27 extending across the width of the simulated tile 25 adjacent the sheet member 40. While the overhang portion 26 is shown as having relatively sharp corners, the protruding section normally is formed with somewhat rounded corners, facilitating vacuum molding of the panel. It is important to note that, as is illustrated by the breakaway portion of FIG. 2 the channel 27 does not extend across the width of the entire panel, but merely across each time simulation, as one very important aspect of the present invention is the discontinuous fore and aft interlocking of the decorative design itself.

Referring again to FIG. 2, front edge 22 of the background sheet member 40 is formed with a downwardly extending lip member 43. Lip 43 and depression 35 define a shelf member 28 which protrudes from the face 29 of the tile member. In a similar manner, left side edge 48 of the background sheet member 40 is formed with a downwardly extending lip member 44, (see also FIG. 7), which tapers from its intersection with front edge lip member 43 to the rear edge 23 of the panel which, in the preferred embodiment is formed with no downwardly extending lip to allow the back portion of the panel to be flat on the subroof. (Note that corresponding portions of different panels are identified by the same numerals for ease of reference). A similar lip 45 is also provided on the right side edge of the panel. The side edge lip members provide a finished appearance to the roofing panel when installed by minimizing the visual effect of any discontinuities between adjacent, installed panels. In addition, the substantially right angle created by each lip and the background sheet member has the desireable effect of increasing the rigidity of the panel. Also the front lip 43 simulates the thickness of inverted tile between adjacent tile simulations 25 and 30.

Referring to FIGS. 2 and 7, channel 50 is formed in the background sheet member substantially parallel to side edge 45 of the panel, and extends from the front edge to the rear edge of the panel. The front edge of the panel is elevated with respect to the rear edge by the depth of lip member 43, the depth of the channel 50 accordingly progressively decreasing from front to rear. Channel 50 is appropriately placed to receive the side edge with wedge shaped lip 44 of an adjacent installed panel, thereby interlocking the adjacent side edges. Also extending upward from the background sheet member 40 between channel 50 and side edge 45 is an elongated protrusion 46, terminating just short of the forward edge 22 of the panel and just before the forward lip 43 of the next adjacent upper panel in roof installations. As may be seen in FIG. 2, when a course of panels is installed, protrusion 46 is disposed beneath a tile member of the adjacent panel, and serves as a dam against water seepage beneath the edge of the panel 20.

The exposed surface of the panel is preferably fabricated with a somewhat roughened texture to more accurately simulate the appearance of ceramic tile. The portions of the background member between the tile segments in the tile roof are also textured to simulate the appearance of the inverted tiles. The two tile members of the panel may also be fabricated with slight but visually perceptible differences in size, if desired. When the panels are installed in vertically staggered courses, the panels present a somewhat irregular appearance to help break up the repetitious appearance which would otherwise be presented by the roofing.

Figure 4:
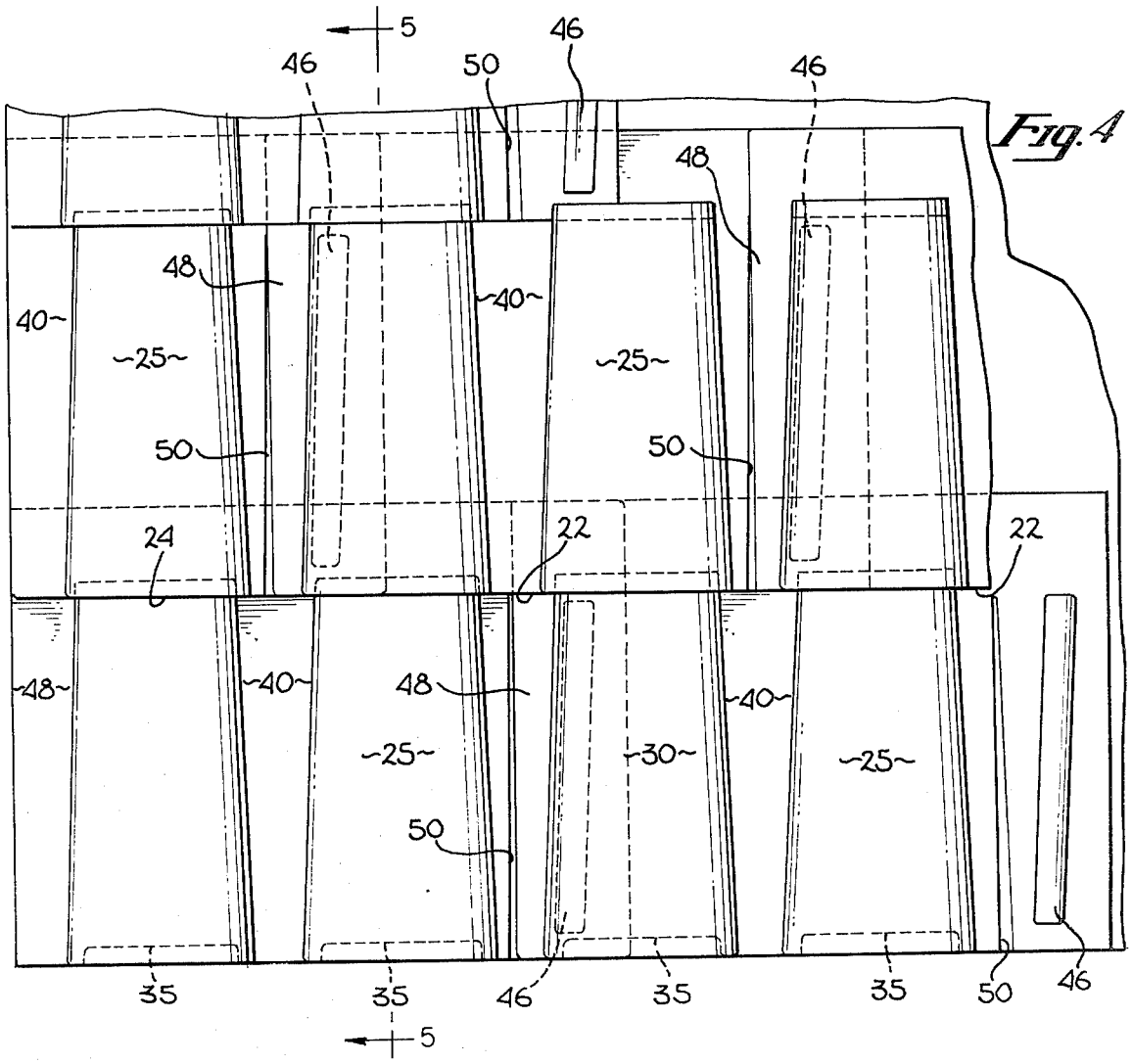
FIG. 4 is an enlarged top view of the roofing panels of FIG. 3 taken on line 4—4 of FIG. 3.

Having described the structure of the invented panel, the installation and manner of interfitting and interlocking the adjacent panels may now be described with reference to FIGS. 3 through 8. With regard to the installation of the roofing, the hips, ridges and edges of the roof are finished and covered with the appropriate starters and finishing caps as is well known in the art, and hence are not illustrated in the figures. The first course of panels is laid along the lowermost edge of the roof. FIGS. 3 and 4 illustrating horizontal courses of panels on a roof. The panels in an individual course would be laid from left to right, as viewed facing the roof, since the protrusion 46 and channel 50 formed in the background sheet member 40 are formed in the background sheet member along the right side edge of each panel. Therefore, referring to FIG. 3, panel 10 (or half panel as shown) would first be laid and nailed down along the rear edge as illustrated by the nailheads 60. Panel 11 is next laid in position, with the left edge of the panel overlapping the right side of the panel 10, the left side tile member fitting over the elongated protrusion formed in panel 10, and the side lip of panel 11 fitting into the side channel of panel 10. Panel 11 may then be nailed down on its rearmost edge. The front portion of the panels along the first course may also be secured with nails driven into channel 50. The entire first course of panels may be then installed in this manner. One of the features of the invention is that the nailing required to secure the panel is hidden entirely by overlapping portions of adjacent panels, so that no nailheads are visible to mar the finished appearance of the installed roof or to be subjected to environmental effects.

Referring now to FIGS. 5 and 6, installation of successive courses may be described. Panel 10 and the other panels of the first course are first installed, as has been described. Panel 15 of the second course is then placed in position above panel 13 such that the leftmost tile member of panel 15 is aligned with and abuts the rightmost tile member of panel 13, i.e.; the panels are disposed in a staggered relationship. (Half panels being used at the sides where necessary). Since there is a perceptible difference in size between the first and second tile elements of each panel, the staggering creates a non-uniform, irregular effect to give a more realistic appearance. As is shown with FIG. 5, this alignment of the panels allows the front edge step 28 of panel 15 to fit into cavity 27 extending along the rear edge of tile member 25 of panel 13. Moreover, since each tile is tapered, the projecting portion 26 of tile 25 fits within the depression formed in the front edge of the tile of panel 25. As the panels of the second course are positioned, the rear edge of the second course of panels is nailed down, and succeeding courses installed until the roofing job is finished. Therefore, the front edge of the second course of panels is affixed in position by the interlocking of the overhang portion 26, and the lip 33. Since the rear edge of the background sheet member 40 extends well beyond and behind the rear edge of the tile members of each panel, it may be seen that this interfitting and interlocking of panels achieves a substantially water-tight roof covering, in that since each roof is sloped, any water that does flow between the abutting surfaces of the tiles of each panel will drain harmlessly downward to flow out over the upper surface of the next lower panel. Moreover, the interfitting of the adjacent sides of the panels diverts the rain water along the side channel in panel for downward flow. Therefore, a roof of properly installed panels will be substantially watertight.

It will be noted that in the panels hereinbefore described, as is the case with all panels in accordance with the present invention, the interlocking between adjacent panels going up the roof is achieved by a discontinuous interlocking of the decorative pattern itself. Thus, in the case of the Spanish tile panels hereinbefore described, portions of the tappered tile sections interlock so that each panel (other than the starter row) need only be nailed down along its upper edge being held down at spaced-apart locations along its lower edge by the interlocking of the decorative design with the decorative design of the lower course. This has substantial advantage not only in the simplicity of installation, but also in providing for the free-floating of the lower edge of each panel within the interfitting region to allow for differential expansion over the environmental extremes. This intermittent interlocking is particularly advantageous with respect to panels simulating various tile designs (whether the Spanish tile illustrated herein or any other design simulating clay tile type roofing products of different aesthetic character) since such tile designs are generally characterized by relatively deep three dimensional patterns, providing excellent rigidity to the panel to avoid buckling and disengagement of the interlocking regions. It will be more specifically noted that the embodiment hereinbefore described is characterized by not only a discontinuous interlocking region along the upper edge of the decorative panel, but also cooperatively disposed discontinuous means for cooperating therewith to provide the interlocking function.

One of the great advantages of the present invention utilizing the discontinuous interlocking scheme dependent upon the decorative character of the panels, is that the scheme allows the maximum accentuation of the decorative pattern to provide maximum simulation without interfering with the interlocking means. Thus, while the invention is particularly useful with tile simulations of various kinds because of their pronounced three dimensional character, it is also useable on shake simulation, as it allows the maximum accentuation of individual shake by maximizing the depressions between shake without causing an interruption thereof by the interlocking structure, while still providing a strong and reliable interlocking in the vertically adjacent portions of the simulated shake.

Now referring to FIGS. 9 and 10, an alternate embodiment of the present invention may be seen. In this embodiment the panel is fabricated of solid urethane or other substantially rigid foam. The forward end **22*a* of the panel projects forward of the tile simulations 25*a* and 30*a* , the tile simulations having a front face 35*a* which is not substantially recessed with respect to the cylindrical or tappered cylindrical section. Of course, as before a downward projecting lip 43*a* is provided at the front of the panel. The cross-sectional configuration of rear portion of these panels may be unchanged from the embodiment hereinbefore described. Accordingly with the front configuration on FIG. 9 the panels will interlock as illustrated in FIG. 10. This embodiment may be fabricated by injection molding or other foam molding techniques, and results in a panel having increased rigidity, stength and insulating properties. Typically, the urethane foam will be covered with a thin plastic skin or coating to present a realistic tile appearance and to increase the durability of the panel. Other slight changes to the design of the panel are incorporated for use of the solid foam; the channel along a side edge is eliminated, and a hollow space under one of the tile members is formed to accommodate the elongated protrusion 46*a***.

Finally referring to FIG. 11 a still further alternate embodiment is illustrated. In this embodiment a separate element 61 having rearward extending portions 62 is vacuum formed or molded and fastened to the relatively flat back of each tile 64 to provide the rearward projection for interfitting into the depression formed in the forward portion of each simulated tile on the adjacent panel. Coupling of the member 61 to the back wall of the simulated tile may be accomplished by solvent welding, ultrasonic welding or any other suitable plastic joining techniques. This embodiment is advantageous in that though separate parts are required, the overall design reduces the degree of forming required to vacuum form the rear portions of the panels thereby making the panels easier to form and reducing the extent of stretching and thining of the panels in this region.

There has been described herein certain preferred embodiments of the invention. Other variations and embodiments will be readily apparent to those skilled in the art. For example, the depression 35 could well be eliminated; instead the front edge of the tile members could be set back from the front edge of the panel to form the protruding step. As has previously been mentioned, the principles disclosed herein may be adapted to panels utilizing decorative elements other than tiles, such as shake roofing materials or a variation on the tile having a trapezoidal cross-sectional configuration.

I claim:

1. A roofing panel having decorative elements, and adapted to interfit with similar roofing panels when installed, comprising:

a background sheet means having front, rear and first and second side edges;

decorative element means extending from said background sheet means and having first and second ends, said first end adjacent said front edge of said sheet means, and said second end adjacent said rear edge of said sheet means, said decorative element means having at said ends complimentary members of a discontinuous interlock means for interlocking said roofing panel with a similar panel vertically disposed adjacent thereto;

protruding surface means protruding from said first end of said decorative element means adjacent said sheet means; and overhang surface means extending from said second end of said decorative element means above and spaced from said sheet means to define a first channel extending along said second end of said decorative element means, said protruding surface means and said overhang surface means adapted for cooperative fit of said protruding surface means into said first channel to form said discontinuous interlock means, said interlock means being coincident with said decorative means;

whereby when installed in endwise, vertical adjacency with said similar roofing panels, said overhang surface means cooperatingly engages with said protruding surface means so that said complimentary members of vertically adjacent decorative elements interlock said roofing panels together, said discontinuous interlocking means residing in said decorative element and serving to minimize the visual effect of the junctions and discontinuities between said vertically adjacent roofing panels.

2. The roofing panel of claim 1 wherein said rear edge of said background sheet member extends beyond said overhang surface means.

3. The roofing panel of claim 2 wherein said decorative element means comprises at least one simulated tile segment, said tile segment having an arcuate cross-sectional configuration.

4. The roofing panel of claim 3 wherein said first end of said tile segment has a depression formed therein substantially in conformance with the cross-sectional configuration of said tile segment to simulate a hollow tile appearance.

5. The roofing panel of claim 4 wherein said protruding surface comprises a lip member extending downwardly from said front edge of said background member.

6. The roofing panel of claim 5 wherein said protruding surface means comprises a step member defined by said depression and said lip member.

7. The roofing panel of claim 6 wherein said simulated tile elements are integrally formed with said background sheet means.

8. The roofing panel of claim 7 wherein said first side edge of said panel has a downwardly extending lip portion formed therein, said lip portion being tapered from the panel front edge to rear edge.

9. The roofing panel of claim 8 wherein a second channel is integrally formed in said background sheet means between said decorative element and said second panel side edge, said second channel adapted to receive the side lip member of a similar panel disposed laterally adjacent thereto and thereby interfitting with said similar panel and whereby the visual effect of the junctions and discontinuities between laterally adjacent panels are minimized.

10. The roofing panel of claim 9 further comprising an elongated protrusion extending upwardly from said background member between said channel and said second side edge, said protrusion adapted for disposition beneath a decorative element of said laterally adjacent roofing panel, said protrusion enhancing the interfitting of said roofing panel with said laterally disposed similar panel and acting as a barrier to the seepage of water under said similar panel disposed laterally adjacent thereto.

11. The roofing panel of claim 10 wherein said simulated tile elements are tapered from panel front to rear.

12. The roofing panel of claim 1 wherein portions of said rear edge are adapted for disposition immediately adjacent the subroof for nailing said rear edge of said panel to said subroof, the front edge of the next vertically adjacent panel overlapping and hiding said portions of said rear edge nailed to said subroof, said front edge of the next vertically adjacent panel being affixed in position by the interlocking of said complimentary members and still being free-floating to allow for differential thermal expansion over the environmental temperature extremes.

13. A roofing panel having decorative elements, and adapted to interfit with similar roofing panels, comprising:

background sheet means having front, rear and first and second side edges;

decorative element means extending from said background sheet means and having a first end and a second end, said first end adjacent said front edge of said sheet means, and said second end adjacent said rear edge of said sheet means, said decorative element means having at said second end the first complimentary member of a discontinuous interlock means for interlocking said roofing panel with a similar panel vertically disposed adjacent thereto;

protruding surface means protruding from said front edge of said sheet means forward of said first ends of said decorative element means, said protruding surface forming the second complementary member of said interlock means; and overhang surface means extending from said second end of said decorative element means above and spaced from said sheet means to define a channel extending along said second end of said decorative element means thereby forming said first complimentary member, said protruding surface means and said overhang surface means adapted for cooperative fit of said protruding surface means into the corresponding channel of an adjacent panel to form said discontinuous interlock means, said interlock means being coincident with said decorative element means;

whereby when said panel is installed in vertical adjacency with similar roofing panels, said overhang surface means of said panel cooperatively engages with the corresponding protruding surface means of the adjacent panel so that said complementary members of vertically adjacent panels discontinuously interlock at positions corresponding to the spacial arrangement of said decorative element means.

14. The roofing panel of claim 13 wherein said rear edge of said background sheet member extends beyond said overhang surface means.

15. The roofing panel of claim 13 wherein said decorative element means comprises at least one simulated tile segment, said tile segment having an arcuate cross-sectional configuration.

16. The roofing panel of claim 13 wherein said simulated tile elements are integrally formed with said background sheet means.

17. The panel of claim 13 wherein said panel is fabricated as an integral solid foam member.

18. The roofing panel of claim 17 further comprising an elongated protrusion extending upwardly from said background member along said first side edge, said protrusion adapted for disposition beneath a decorative element of a laterally adjacent similar panel, said protrusion acting as a barrier to the seepage of water under said laterally adjacent similar panel.

19. The roofing panel of claim 18 wherein said decorative element means are tapered from panel front to rear.

20. The roofing panel of claim 13 wherein portions of said rear edge are adapted for disposition immediately adjacent the subroof for nailing said rear edge of said panel to said subroof, the front edge of the next vertically adjacent panel overlapping and hiding said portions of said rear edge nailed to said subroof, said front edge of the next vertically adjacent panel being affixed in position by the interlocking of said complimentary members and still being free-floating to allow for differential thermal expansion over the environmental temperature extremes.

21. An integrally formed roofing panel, adapted to interfit with like panels to form a substantially watertight roof covering, comprising a background sheet member of relatively thin material; said background sheet member having first and second elongated tile segments formed in relief therefrom, said tile segments comprising complementary discontinuous interlocking means for interlocking said roof panel, said interlocking means corresponding in position to and coincident with said tile segments, said segments having a first end with a protruding surface therefrom adjacent said sheet member, and a second end having an overhanging portion spaced above the sheet member, said protruding member and said overhang portion cooperatively formed as complementing surfaces to form said discontinuous interlocking means;

portions of said first end being adapted for disposition immediately adjacent the subroof for nailing said first end of said panel to said subroof, the second end of the next vertically adjacent panel overlapping and hiding said portions of said first end nailed to said subroof, said second end of said next vertically adjacent panel being affixed in position by said interlocking means with respect to said subroof.

22. The panel of claim 21 wherein said overhang member comprises a separate element fastened to said second end of said tile segments.

23. A roofing panel adapted to interfit with similar roofing panels when installed, comprising a background sheet means and at least one discrete decorative element extending from said background sheet, said discrete decorative element being tapered from front to back, the back end of said discrete element having a recess extending horizontally along its bottom portion, said back end having a cross-sectional configuration substantially in conformance with the cross-sectional configuration of said decorative element, the front end of said decorative element having a depression formed therein substantially in conformance with said cross-sectional configuration, said front end having a peripheral edge outlining its cross-sectional configuration, said front end adapted to receive in said depression the back end of a discrete decorative element of a similar roofing panel vertically disposed adjacent to it and to peripherally envelop said back end of said similar roofing panel, said background sheet having a lip member extending downwardly from its front and side edges, the portion of said lip member extending downwardly from the side edges of said back sheet being tapered from the panel front edge to its rear edge, said background sheet having a groove disposed vertically in it from the front edge to the rear edge of said panel, said groove disposed between said decorative element and the side edge adjacent to its said groove adapted to receive the portion of a lip member extending downward from the side edge of a similar panel disposed laterally adjacent thereto, said backsheet further having an elongated protrusion extending upwardly between said groove and its adjacent side edge, said protrusion adapted for disposition beneath the decorative element of said laterally adjacent roofing panel, said rear edge of said backsheet adapted for disposition immediately adjacent a sub-roof for nailing said rear edge of said panel to said sub-roof, said rear edge being overlapped and hidden by the front edge of the next vertically adjacent panel, said front edge of the next vertically adjacent panel being affixed in position by the engagement of said back end of said discrete decorative element and the front end of the decorative element of said vertically adjacent panel, said engagement occuring only at spaced intervals corresponding to the junction of vertically adjacent decorative elements of separate panels.

* * * * *